US006514149B2

(12) United States Patent
Yoon

(10) Patent No.: US 6,514,149 B2
(45) **Date of Patent: *Feb. 4, 2003**

(54) MULTILOOP GOLF NET ASSEMBLY

(75) Inventor: Young W. Yoon, 127 Michael Manner, Glenview, IL (US) 60025

(73) Assignee: Young W. Yoon, Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/480,339

(22) Filed: Jan. 7, 2000

(65) Prior Publication Data

US 2002/0049092 A1 Apr. 25, 2002

(51) Int. Cl.[7] ..... A63B 69/36
(52) U.S. Cl. ..... 473/197; 273/400
(58) Field of Search ..... 473/197, 478, 473/434, 454; 273/395, 398, 400, 402

(56) References Cited

U.S. PATENT DOCUMENTS

| | | | | |
|---|---|---|---|---|
| 3,001,795 A | | 9/1961 | Johnson, Jr. | |
| 3,195,898 A | | 7/1965 | Respini | |
| 3,675,667 A | | 7/1972 | Miller | |
| 3,698,712 A | | 10/1972 | Pero | |
| 3,960,161 A | | 6/1976 | Norman | |
| 3,990,463 A | | 11/1976 | Norman | |
| 4,063,739 A | | 12/1977 | La Rose | |
| 4,523,760 A | | 6/1985 | Bednarczuk | |
| 4,825,892 A | | 5/1989 | Norman | |
| 4,858,634 A | | 8/1989 | McLeese | |
| 5,088,740 A | * | 2/1992 | Peterson | 473/197 |
| 5,163,461 A | | 11/1992 | Ivanovich et al. | |
| 5,249,592 A | | 10/1993 | Springer et al. | |
| 5,337,772 A | | 8/1994 | Habchi | |
| 5,421,586 A | | 6/1995 | Amram et al. | |
| 5,427,381 A | | 6/1995 | Macaluso et al. | |

(List continued on next page.)

FOREIGN PATENT DOCUMENTS

| | | |
|---|---|---|
| FR | 8014071 | 6/1980 |
| GB | 21909 | 4/1907 |

OTHER PUBLICATIONS

Hammacher Schlemmer, p. 63.
Excalibur Sun Screen Brochure.
Brookstone Gift Collection, p. 21, Father's Day 1999.
The Golfsmith Store Catalog, p. 32, Jul. 1999 edition.
KWIKGOAL, 1999 Soccer Equipment.
The Golfsmith Store Catalog, p. 44, Holiday 1997.
Golf Day, pp. 22–23, Catalog 129C3.
The Golfsmith Catalog, pp. 99, 1998.
High Street Emporium, p. 122, Summer Fest Fun, Summer 1998.

*Primary Examiner*—Mark S. Graham
(74) *Attorney, Agent, or Firm*—Price, Heneveld, Cooper, DeWitt & Litton

(57) ABSTRACT

A practice golf net assembly includes a pair of collapsible closed, elongated loops interconnected one to the other with a netting panel for receiving and retaining a golf ball or the like on any relatively flat ground surface. A first of the collapsible loops forms a first substantially horizontal periphery and a second of the collapsible loops is attached to opposite sides of the horizontal periphery of the first loop. An arc of the second loop defines a vertical portion disposed perpendicularly to the horizontal periphery of the first collapsible loop, while the remaining arc of the second loop generally defines an horizontal portion proximate a horizontal portion of the first loop. The netting panel is attached to the vertical portion of the second loop and to one of the horizontal portions of the first or second loop to form a substantially vertical netting surface for engaging the ball.

12 Claims, 6 Drawing Sheets

U.S. PATENT DOCUMENTS 5,439,017 A 8/1995 Brown
5,569,094 A 10/1996 Macaluso
RE35,571 E 7/1997 McLeese
5,645,096 A 7/1997 Hazinski et al.
5,676,168 A 10/1997 Price
5,816,278 A 10/1998 Kim
5,842,940 A * 12/1998 Macaluso ..... 473/197
5,976,023 A 11/1999 Cho
5,989,130 A 11/1999 Macaluso
6,135,894 A * 10/2000 Cho ..... 473/197

* cited by examiner

MULTILOOP GOLF NET ASSEMBLY

FIELD OF THE INVENTION

The present invention generally relates to a multi-loop golf net assembly. In particular, the present invention relates to a net assembly formed from first and second closed, elongated collapsible loops coupled to each other to form a vertical periphery and horizontal periphery to which is attached a netting panel to form a substantially vertical netting surface for engaging the ball when practicing golf driving strokes and a substantially horizontal netting surface for engaging the ball when practicing golf pitching strokes.

BACKGROUND OF THE INVENTION

Golf is one of the most popular sports and recreational past times ever. Every year, millions of golfers devote significant time and resources toward improving their golf skills, which primarily include three aspects of the game calling for three separate golf swing skills: driving off the tee or fairway; chip shots for approaching the green; and putting on the green. Playing the game to actually encounter these various aspects of the game at frequent intervals obviously best develops these skills.

While playing a round of golf on a golf course is, of course, the most pleasurable method is develop these skills, playing a round of golf is often difficult and inconvenient. It can require significant time and money. While it is possible to utilize driving ranges, where the golfer can repeatedly practice drive or tee shots from a driving station, it is usually not possible to efficiently practice chip shots or putting. Also, although consuming less time and money than a full round of golf, driving ranges also suffer from the limitations of access and availability to many golfers.

Solutions to this problem have been proposed through the years. One solution has been the development of frame and net structures that can be used at or near the golfer's home. Such nets typically include a circular or square frame forming a periphery to which is attached a mesh or net material. Such frames usually comprise a set of interlocking right-angle poles that, when fully assembled, form a rectangular shape across which a vertical screen or net is a positioned and into which a golf ball may be driven. These frames and nets of the prior art are, however, usually fairly expensive and complex to assemble, particularly when assembled alone. Also, the loss of even a single pole segment renders the entire net useless. Such nets further typically consume significant storage space when not in use.

Other frames comprise self-erecting flexible loops that can be folded upon themselves and which are attached about their periphery to a net or mesh. Although easier to deploy, such frames likewise consume significant space and are typically smaller when deployed and hence of lower utility.

More importantly, the frames and nets of the prior art are primarily dedicated solely to practice of drives off the tee or fairway, and do not contemplate practicing chip shots or putting. In the case of chip shots, it is deemed advantageous to provide a way of providing a horizontal, rather than a vertical, screen or net onto which the golf ball may be chipped. Moreover, it is deemed undesirable that a chip shot, which tends to fall vertically onto a surface, actually fall upon a hard surface. In such situations, the golf ball will tend to bounce and can become a danger to persons nearby and property, especially when used indoors. Similarly, putting shots require a horizontal surface upon which to practice putting the ball into a hole or other cavity, a feature also lacking in the frames and nets of the prior art.

Thus, the prior art lacks a golf practice nets that is capable of allowing practice of driving swing, as well as practice of the chip shot and putting swings. For the foregoing reasons, an unresolved need exists for an improved golf practice net.

SUMMARY OF THE INVENTION

To overcome these and other disadvantages of the prior art, the present disclosure, briefly described, provides an improved multi-loop golf net assembly for engaging and retaining a sports item such as a ball or the like. The assembly may be readily assembled for deployment on any relatively flat ground surface and subsequently readily collapsed for storage. The assembly includes a pair of collapsible closed, elongated loops interconnected one to the other with a netting panel for receiving and retaining a golf ball or the like on any relatively flat ground surface. A first of the collapsible loops forms a first substantially horizontal periphery and a second of the collapsible loops is attached to opposite sides of the horizontal periphery of the first loop. An arc of the second loop defines a vertical portion disposed perpendicularly to the horizontal periphery of the first collapsible loop, while the remaining arc of the second loop generally defines a horizontal portion proximate a horizontal portion of the first loop. The netting panel is attached to the vertical portion of the second loop, to the base panel and to one of the horizontal portions of the first or second loop to form a substantially vertical netting surface for engaging the ball when practicing golf driving strokes and a substantially horizontal netting surface for engaging the ball when practicing golf pitching strokes, where the ball is prevented from contacting the ground in the latter instance.

The multi-loop golf net assembly of the present invention can be readily deployed and collapsed, while providing a net that is very effective for use in number of different golfing swings, such as a driving, chipping and putting.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the preferred embodiment of the disclosure in detail, it is to be understood that the disclosure is not limited in its application to the details of the construction and the arrangements set forth in the following description or illustrated in the drawings. The multi-loop golf net assembly of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

The fundamental aspects of the invention, along with the various features and structures that characterize the invention, are pointed out with particularity in the claims annexed to and forming a part of this disclosure. For a better understanding of the multi-loop golf net assembly of the present disclosure, its advantages and the specific objects attained by its uses, reference should be had to the accompanying drawings and descriptive matter in which there are illustrated preferred embodiments of the invention.

While embodiments of the multi-loop golf net assembly are herein illustrated and described, it is to be appreciated that various changes, rearrangements and modifications may be made therein, without departing from the scope of the invention as defined by the appended claims.

BRIEF DESCRIPTION OF THE FIGURES

The disclosure of the multi-loop golf net assembly is explained with illustrative embodiments shown in the accompanying drawing, where.

DETAILED DESCRIPTION OF THE PREFERRED EMBODIMENT

Figure 1:
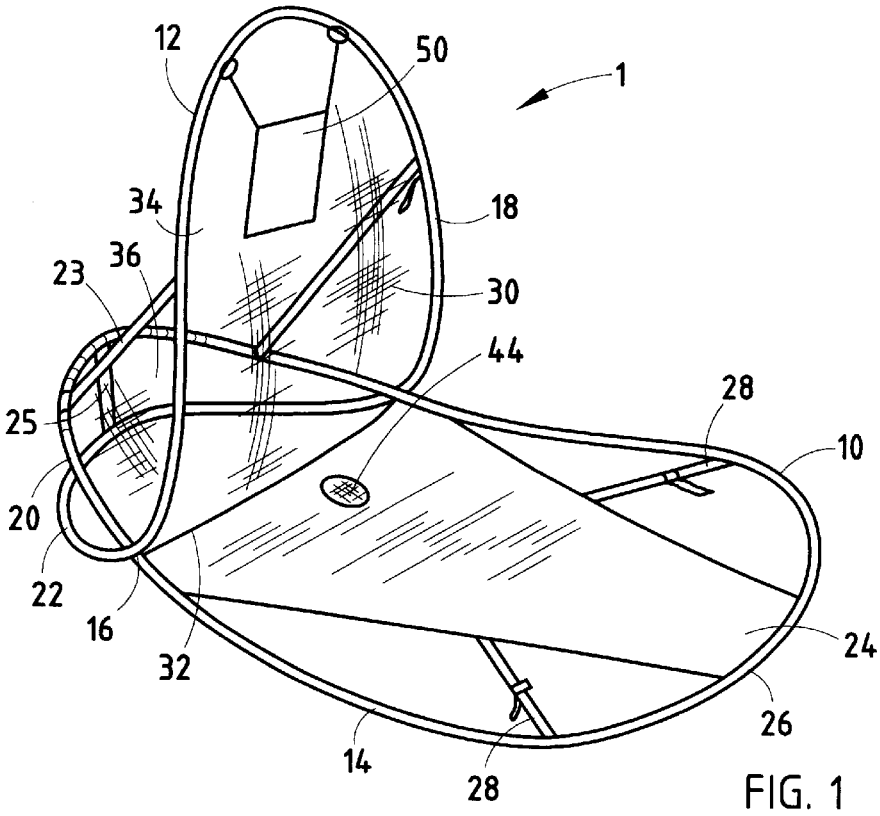
FIG. 1 is a perspective overall view of a first end of a first preferred embodiment of the present invention.

The best mode for carrying out the invention is presented in terms of the preferred embodiment, wherein similar reference characters designate corresponding features throughout the several figures of the drawings.

Referring now to the drawings, particularly FIG. 1, there is shown in perspective view the multi-loop golf net assembly of the present invention. The multi-loop golf net assembly 1 consists primarily of a pair of closed, elongated collapsible loops 10, 12. Each of the loops 10, 12 has a memory urging them to a circle in a single flat plane. While steel loops may be used, loops fabricated from fiberglass of about 0.25 inch in diameter are preferred. Each of the loops is also preferably encased in nylon webbing throughout. The loops 10, 12 are preferably of the same dimensions, which is preferably 4 to 8 feet in diameter.

The first loop 10, as shown in the Figures, is disposed generally horizontally to define a horizontal periphery 14. The second loop 12 is coupled to opposite sides of the horizontal periphery 14 of the first loop 10 at attachment 16. The second loop 12 is curled back, against its memory, such that an arc of the second loop 12 generally defines an arcuate vertical portion 18. The vertical portion 18 is disposed substantially orthogonally to the first loop 10. The remaining arc of the second loop 14 generally defines a horizontal portion 22 proximate a horizontal portion 20 of the first loop. As shown, the horizontal portion 20 of the first loop 10 is disposed above and substantially parallel to the horizontal portion 22 of the second loop 12, such that the horizontal portion 20 of the first loop is elevated relative to the horizontal portion 22 of the second loop and the ground surface. This relationship is further maintained by a pair of adjustable nylon webbing straps 23 that extend between the horizontal portion 20 of the first loop 10 and the vertical portion 18 of the second loop 12, as is known to adjust the tension upon the second loop 12. Similarly, an adjustable nylon webbing strap 25 extends between the horizontal portion 20 of the first loop 10 and the horizontal portion 22 of the second loop 12.

Figure 2:
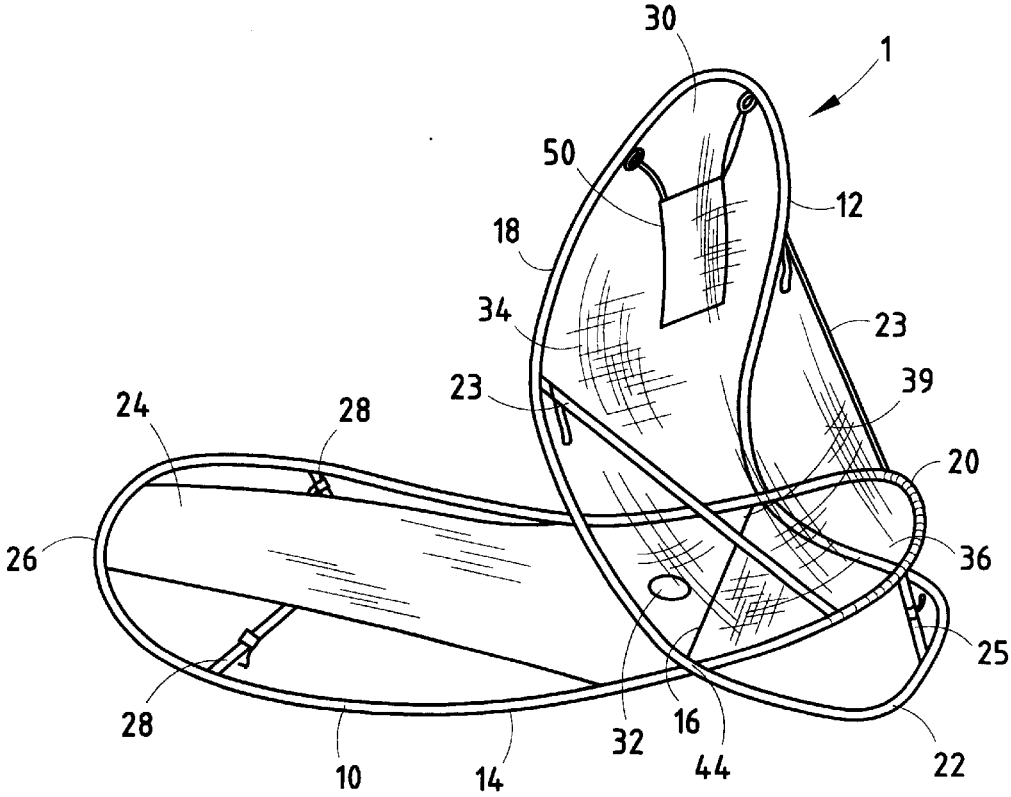
FIG. 2 is a perspective overall view of a second end of the first preferred embodiment of the present invention.
Figure 3:
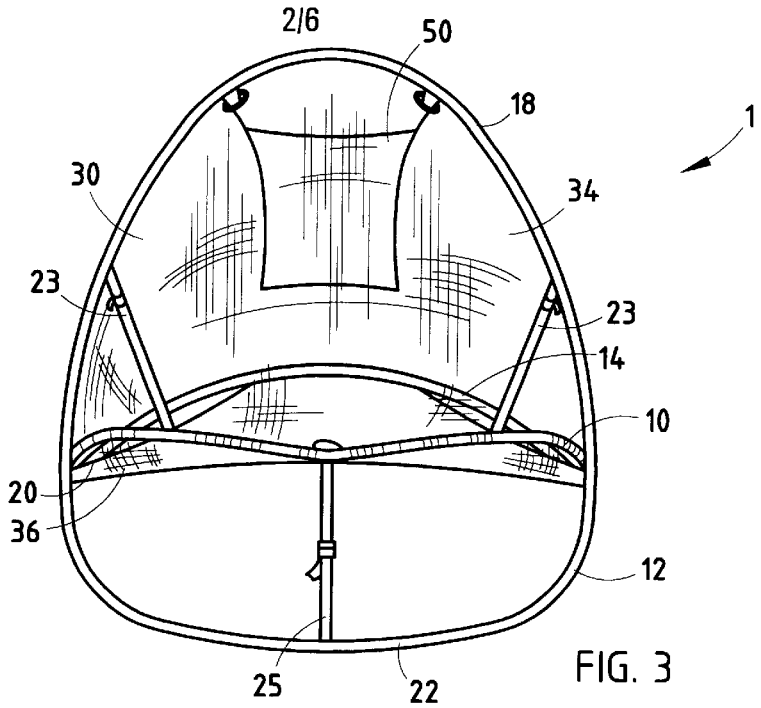
FIG. 3 is a plan view of the second end of the first preferred embodiment of the present invention.
Figure 4:
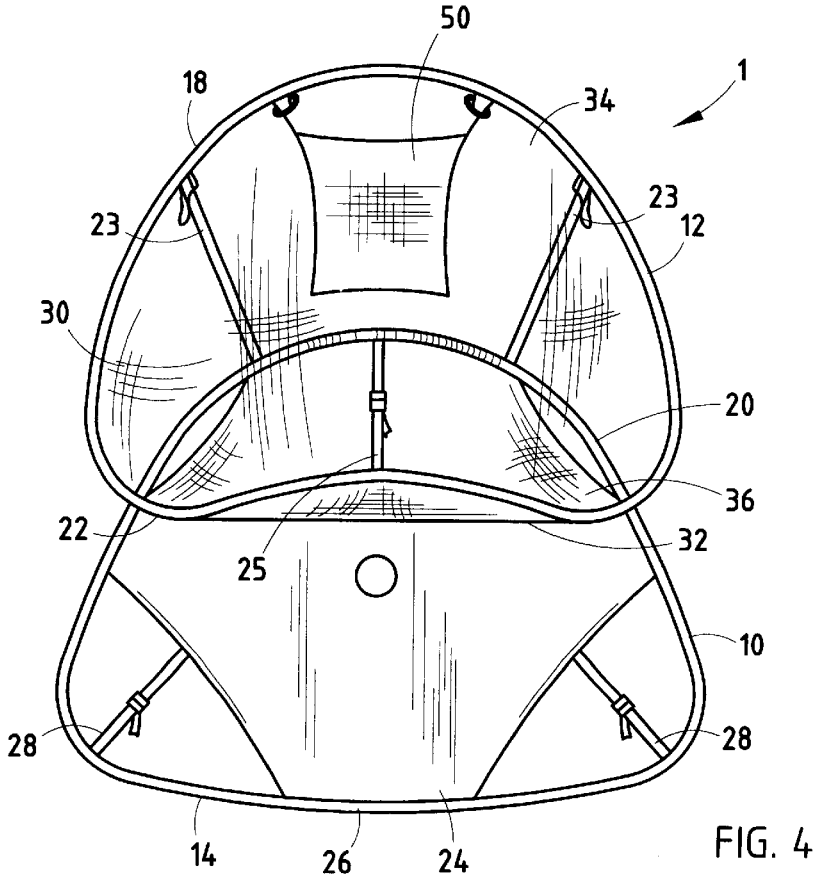
FIG. 4 is a plan view of the first end of the first preferred embodiment of the present invention.

Preferably, a flexible base panel 24 is attached to the webbing encasing the first loop 10 at a distal end 26 thereof and proximate the attachment 16 on either side of the periphery 14. The preferred material for the base panel 24 is heavy duty nylon. As shown in FIGS. 1, 2 and 4, the base panel 24 is attached under tension such that the first loop 10 is also slightly curled back, against its memory, to form a structure that resembles a potato chip, but is nevertheless substantially horizontal. The base panel 24 is also preferably provided with a pair of adjustable nylon webbing straps 28 on each side, as is known, connected each to the base panel 24 and the loop 10 in order to further adjust the tension on the base panel 24. In the preferred embodiment, the base panel is provided with a putting hole 44 with an appropriate netting, whereby the multi-loop golf net assembly 1 of the present invention can also be used to practice putting along the length of the base panel 24, as well as for driving and chipping shots.

Figure 5:
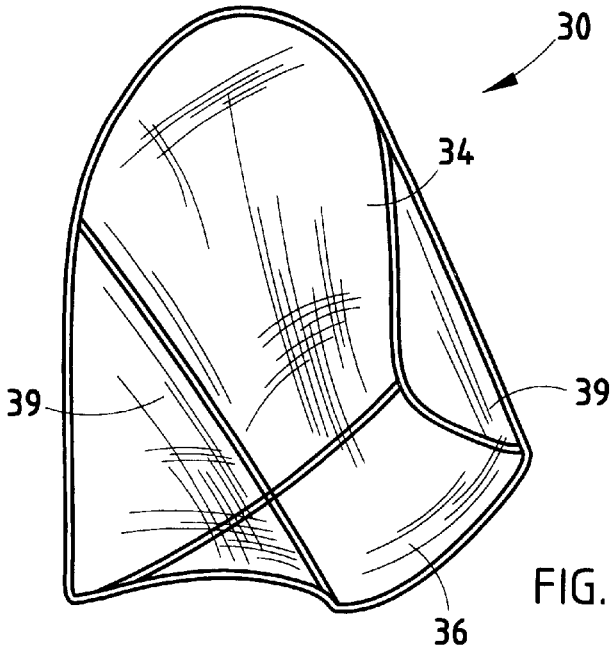
FIG. 5 is a perspective view of the net of the present invention.

A netting assembly 30, shown independently in FIG. 5, is preferably attached to the vertical portion 18 of the second loop, to an edge 32 of the base panel 24 and to one of the horizontal portions 20, 22 of the first and second loops 10, 12. The netting assembly 30 is formed from a netting sheet of netting that is attached to the vertical portion 18 preferably by sewing the netting assembly 30 onto the webbing encasing the second loop 12 in the arc defining the vertical portion 18. At about the midpoint of the netting sheet, the netting assembly is loosely attached to the horizontal portion 20 of the first loop 10 (or the horizontal portion 22 of the second loop, discussed below) by, while the remaining end is sown to the edge 32 of the base panel 24.

Figure 6:
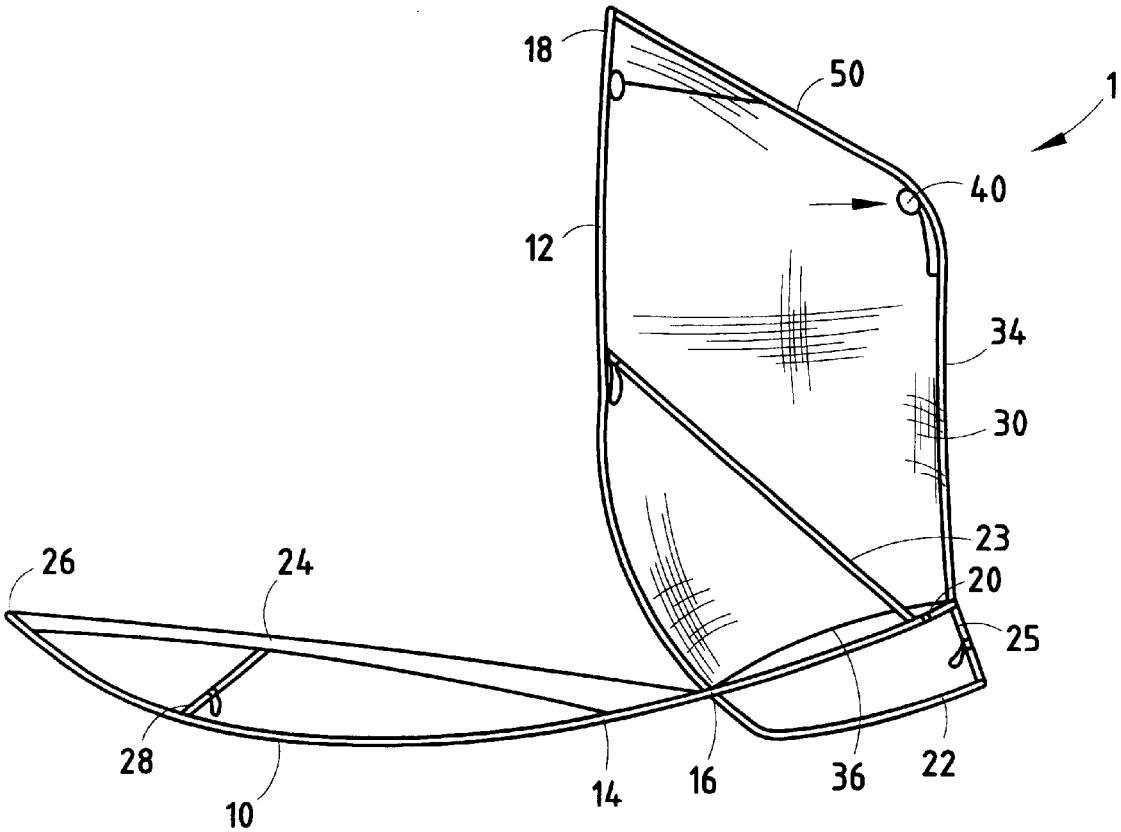
FIG. 6 is a side view of the first preferred embodiment of the present invention engaging a ball that has been driven into the net.
Figure 7:
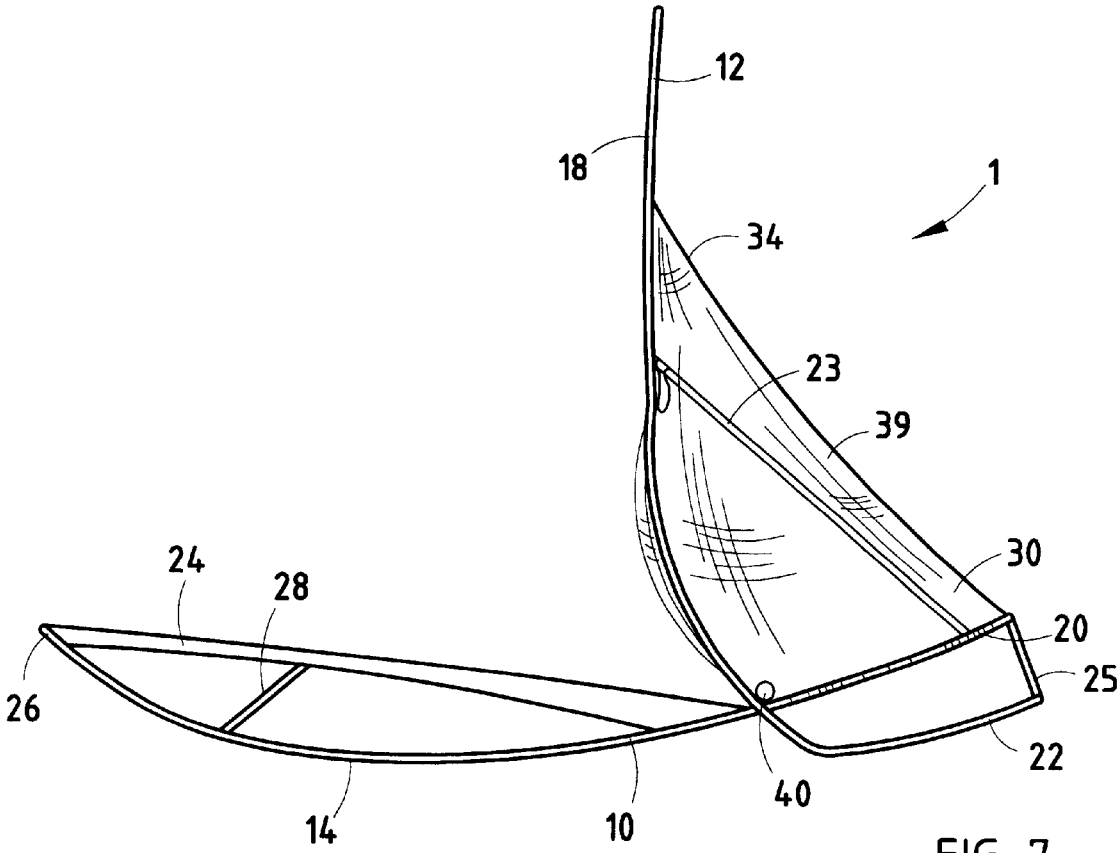
FIG. 7 is a side view of a first preferred embodiment of the present invention engaging a ball that has been chipped into the net.

The result is a substantially vertical netting surface 34 for engaging the ball 40 when practicing golf driving strokes, as particularly shown in FIG. 6. A target 50 can be advantageously attached to further promote accuracy. After the drive stroke, the ball hits the target 50 of the vertical netting surface 34 and falls gently onto the base panel 24 for ready retrieval. Also resulting from this arrangement is a substantially horizontal netting surface 36 for engaging the ball 40 when practicing golf pitching strokes, as through a cupping action, as particularly shown in FIG. 7. As in the drive stroke, after the chipping shot, the ball 40 engages the horizontal netting surface 26, where the same remains ready for retrieval. The latter function is further advanced by side wings 39 formed from the natural slack in the netting assembly 30 that forms a barrier against the ball 40 from falling out of the horizontal netting surface 36.

As shown in the Figures, the horizontal netting surface 36 is elevated relative the ground surface. Thus, when practicing a chipping stroke, the ball 40 lands onto the horizontal netting surface 36 and does not contact the ground surface. This provides a significant advantage in that the assembly 1 can be deployed on a hard surface, such as dry ground or concrete, and the ball 40 will not bounce upon striking such a hard surface. Rather, the ball 40 will land in the horizontal netting surface 36 and gently come to a rest.

Figure 9:
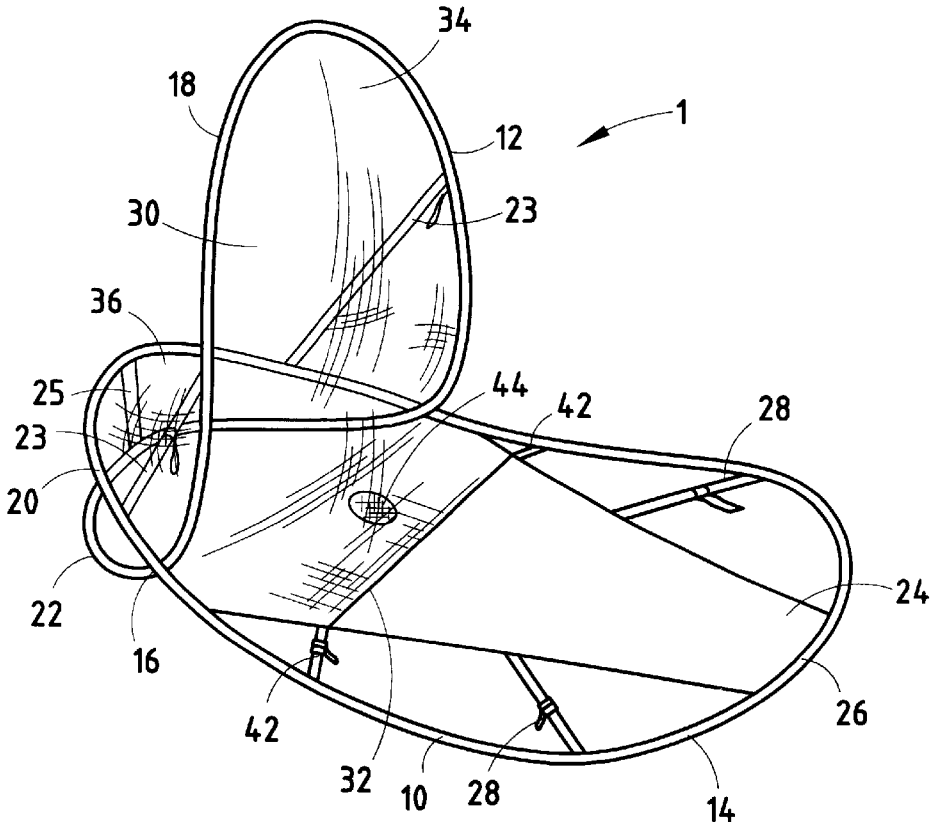
FIG. 9 is a perspective overall view of the first end of a second preferred embodiment of the present invention.
Figure 10:
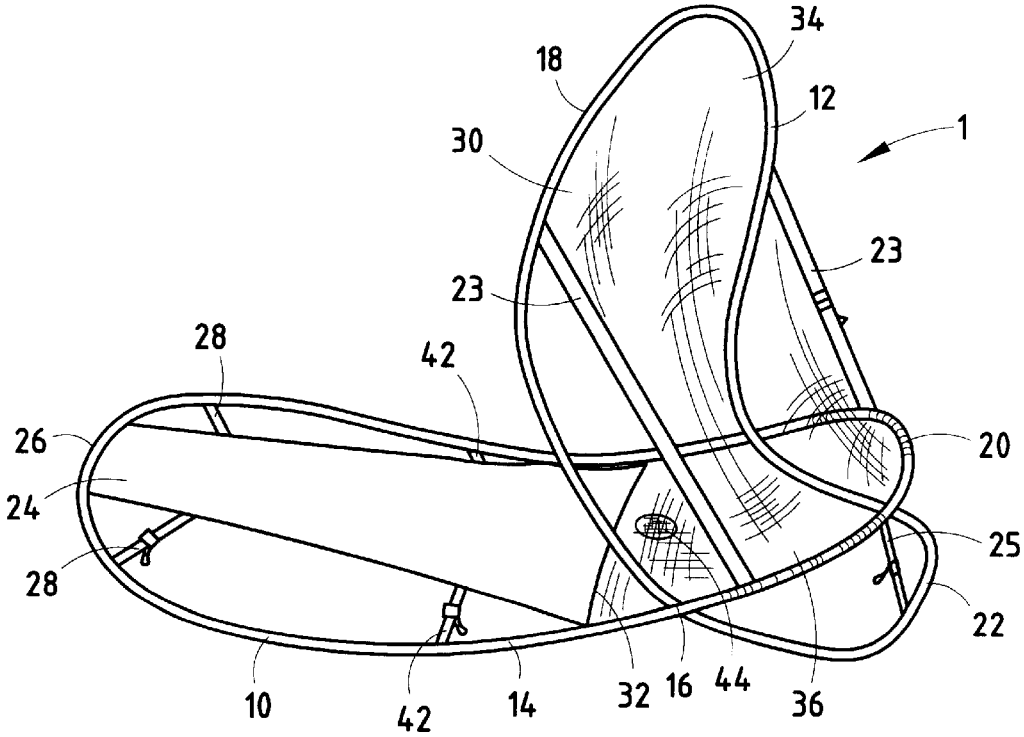
FIG. 10 is a perspective overall view of the second end of the second preferred embodiment of the present invention.

An alternative embodiment is shown in FIGS. 9 and 10. There, the rear edge 32 of the base panel 24 is located more toward the distal end 26 of the first loop 10, such that the horizontal netting surface is extended more toward the distal end 26 of the first loop 10. Adjustable nylon webbing straps 42 provide additional support and tension to the base panel 24. As shown, the horizontal surface 36 of the netting assembly 30 of this embodiment further includes the putting hole 44.

Figure 8:
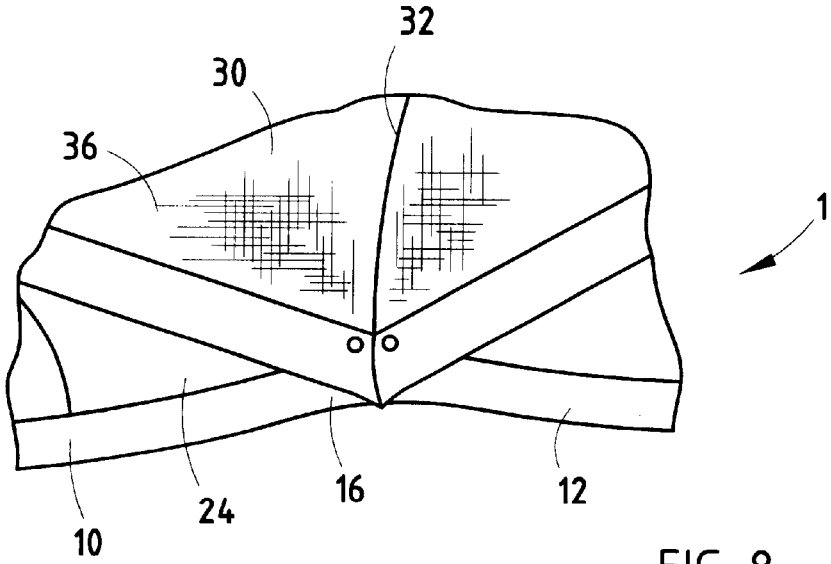
FIG. 8 is a perspective view of a portion of the first preferred embodiment of the intersection of the closed, elongated loops of the present invention.

In the embodiment shown in FIGS. 1–10, the horizontal portion 20 of the first loop 10 is disposed above the horizontal portion 22 of the second loop 12, and the netting assembly 30 is attached to the horizontal portion 20 of the first loop 10 to the form the horizontal netting surface 36. As shown in FIG. 8, the first loop 10 and the second loop 12 intersect at attachment 16, which is obtained by sewing the webbing encasing the loops 10, 12 together to form a cross.

Figure 11:
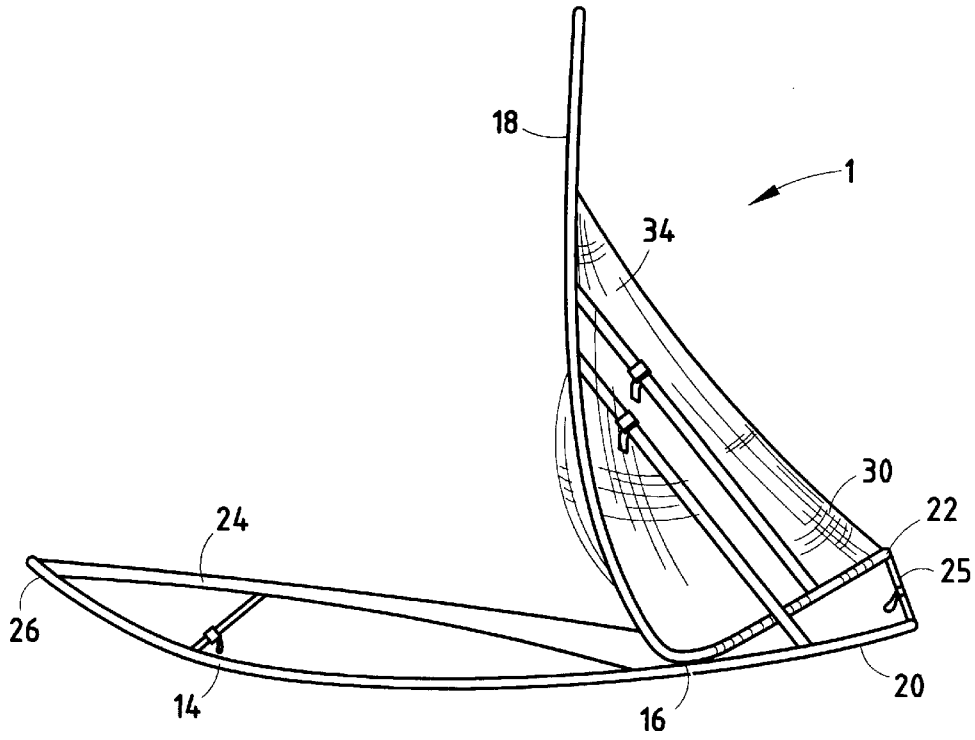
FIG. 11 is a side view of a third preferred embodiment of the present invention.
Figure 12:
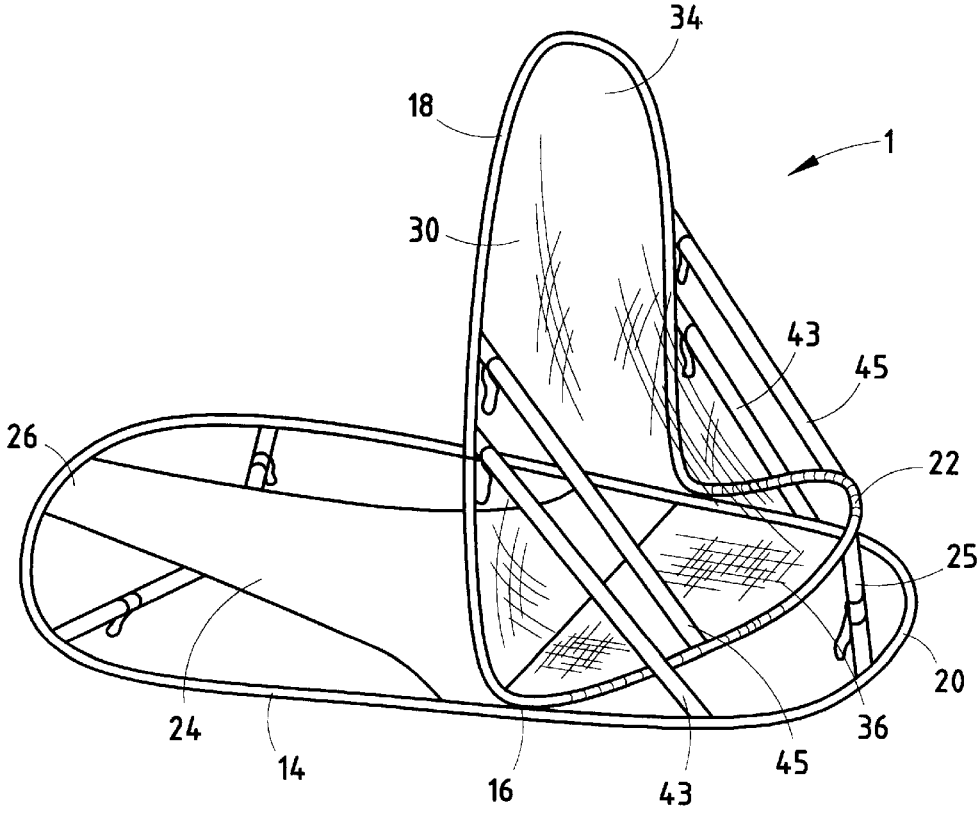
FIG. 12 is a perspective overall view of a second end of the third preferred embodiment of the present invention.

In another preferred embodiment shown in FIGS. 11–12, however, the horizontal portion 22 of the second loop 12 is disposed above the horizontal portion 20 of the first loop 10, such that the netting assembly is attached to the horizontal portion 22 of the second loop 12. This is obtained by urging the second loop 12 far back against its memory, such that an arc of the second loop 12 generally defines an arcuate vertical portion 18 and the remaining arc of the second loop 12 forms the horizontal portion 22. So situated, the loops 10, 12 do not intersect, but are simply rather sown together at 16 as shown in FIG. 1. Straps 23 are replaced with straps 43 and 45. Adjustable nylon webbing straps 43 connect the horizontal portion 20 of the first loop 10 to the vertical portion 18 of the second loop 12, while adjustable nylon webbing straps 45 connect the horizontal portion 22 of the second loop 12 to the vertical portion 18 of the second loop 12.

The steps required to compact the multi-loop golf net assembly 1 of the invention are relatively few and straightforward, and may easily be achieved by a person working alone. The preferred method of compacting the loops 10, 12 of the invention which results in a final compacted circle structure of four turns representing a diameter of approximately one half of the erected frame diameter. To compact the deployed assembly 1, the horizontal portion 20 and distal end 26 of the first loop 10 and the vertical portion 18 and horizontal portion 22 of second loop 12 are brought toward one another. Once together, one or the other is twisted 180°, so that assembly 1 assumes the general shape of a figure eight. The figure eight shape is then folded to form four coincident circles. Preferably, the resulting diameter is 4 feet inches or less. Restraints may be placed about this compacted structure to hold it in compacted shape. Deploying the assembly 1 is simply the reverse. The loops 10, 12 are simply uncoiled and allowed to unfold until the straps and panels restrict further movement, and the assembly 1 assumes the shape shown in the Figures.

The solutions offered by the invention herein have thus been attained in an economical, practical, and facile manner. While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed is:

1. A multi-loop golf net assembly for receiving and retaining a golf ball or the like, wherein said assembly is deployable on any relatively flat ground surface and is collapsible for storage, the net assembly when deployed comprising:

a first closed, elongated collapsible loop generally defining a horizontal periphery, an are thereof further defining a horizontal portion, a second closed, elongated collapsible loop coupled to opposite sides of the periphery of the first loop, an arc of the second loop generally defining a vertical portion disposed substantially orthogonally to the first collapsible loop and the remaining arc of the second loop generally defining a horizontal portion proximate the horizontal portion of the first loop, a base panel attached to the horizontal periphery of the first loop, a netting assembly attached to the vertical portion of the second loop, to the base panel and to one of the horizontal portions of the first and second loop to form a substantially vertical netting surface for engaging the ball when practicing golf driving strokes and a substantially horizontal netting surface for engaging the ball when practicing golf pitching strokes, and wherein the horizontal portion of the first loop is disposed above the horizontal portion of the second loop.

2. The multi-loop golf net assembly of claim 1, wherein the horizontal netting surface is elevated relative the ground surface, wherein the ball does not contact the ground surface when practicing golf pitching strokes.

3. The multi-loop golf net assembly of claim 1, wherein the first and second loops are encased in circumferential webbing and the webbing of the second loop is fixedly attached to the webbing of the first loop at opposite sides of the periphery of the first loop.

4. The multi-loop golf net assembly of claim 3, wherein the base panel is comprised of nylon and is attached to the circumferential webbing of the first loop.

5. The multi-loop golf net assembly of claim 1, wherein the substantially vertical netting surface for engaging the ball when practicing golf driving strokes further comprises a target disposed substantially centrally thereon.

6. The practice golf net assembly of claim 1, wherein the first and second loops intersect at the points where the second loop is attached to the opposite sides of the horizontal periphery of the first loop.

7. The practice golf net assembly of claim 1, wherein the first and second loops are of the same diameter.

8. A multi-loop golf net assembly for receiving and retaining a golf ball or the like, wherein said assembly is deployable on any relatively flat ground surface and is collapsible for storage, the net assembly when deployed comprising:

a first closed, elongated collapsible loop generally defining a horizontal periphery, an are thereof further defining a horizontal portion, a second closed, elongated collapsible loop coupled to opposite sides of the periphery of the first loop, an arc of the second loop generally defining a vertical portion disposed substantially orthogonally to the first collapsible loop and the remaining arc of the second loop generally defining a horizontal portion proximate the horizontal portion of the first loop, a base panel attached to the horizontal periphery of the first loop, a netting assembly attached to the vertical portion of the second loop, to the base panel and to one of the horizontal portions of the first and second loop to form a substantially vertical netting surface for engaging the ball when practicing golf driving strokes and a substantially horizontal netting surface for engaging the ball when practicing golf pitching strokes, wherein the horizontal portion of the first loop is disposed above the horizontal portion of the second loop, and wherein the netting assembly is attached to the horizontal portion of the first loop.

9. A multi-loop golf net assembly for receiving and retaining a golf ball or the like, wherein said assembly is deployable on any relatively flat ground surface and is collapsible for storage, the net assembly when deployed comprising:

a first closed, elongated collapsible loop generally defining a horizontal periphery, an are thereof further defining a horizontal portion, a second closed, elongated collapsible loop coupled to opposite sides of the periphery of the first loop, an arc of the second loop generally defining a vertical portion disposed substantially orthogonally to the first collapsible loop and the remaining arc of the second loop generally defining a horizontal portion proximate the horizontal portion of the first loop, a base panel attached to the horizontal periphery of the first loop, a netting assembly attached to the vertical portion of the second loop, to the base panel and to one of the horizontal portions of the first and second loop to form a substantially vertical netting surface for engaging the ball when practicing golf driving strokes and a substantially horizontal netting surface for engaging the ball when practicing golf pitching strokes, and wherein the arcuate horizontal portion of the second loop is disposed above the horizontal portion of the first loop.

10. The practice golf net assembly of claim 9, wherein the first and second loops do not intersect.

11. A multi-loop golf net assembly for receiving and retaining a golf ball or the like, wherein said assembly is deployable on any relatively flat ground surface and is collapsible for storage, the net assembly when deployed comprising:

a first closed, elongated collapsible loop generally defining a horizontal periphery, an are thereof further defining a horizontal portion, a second closed, elongated collapsible loop coupled to opposite sides of the periphery of the first loop, an arc of the second loop generally defining a vertical portion disposed substantially orthogonally to the first collapsible loop and the remaining arc of the second loop generally defining a horizontal portion proximate the horizontal portion of the first loop, a base panel attached to the horizontal periphery of the first loop, a netting assembly attached to the vertical portion of the second loop, to the base panel and to one of the horizontal portions of the first and second loop to form a substantially vertical netting surface for engaging the ball when practicing golf driving strokes and a substantially horizontal netting surface for engaging the ball when practicing golf pitching strokes, wherein the arcuate horizontal portion of the second loop is disposed above the horizontal portion of the first loop, and wherein the netting assembly is attached to the horizontal portion of the second loop.

12. A multi-loop golf net assembly for receiving and retaining a golf ball or the like, wherein said assembly is deployable on any relatively flat ground surface and is collapsible for storage, the net assembly when deployed comprising:

a first closed, elongated collapsible loop generally defining a horizontal periphery, an are thereof further defining a horizontal portion, a second closed, elongated collapsible loop coupled to opposite sides of the periphery of the first loop, an arc of the second loop generally defining a vertical portion disposed substantially orthogonally to the first collapsible loop and the remaining arc of the second loop generally defining a horizontal portion proximate the horizontal portion of the first loop, a base panel attached to the horizontal periphery of the first loop, a netting assembly attached to the vertical portion of the second loop, to the base panel and to one of the horizontal portions of the first and second loop to form a substantially vertical netting surface for engaging the ball when practicing golf driving strokes and a substantially horizontal netting surface for engaging the ball when practicing golf pitching strokes, wherein the first and second loops are encased in circumferential webbing and the webbing of the second loop is fixedly attached to the webbing of the first loop at opposite sides of the periphery of the first loop, wherein the base panel is comprised of nylon and is attached to the circumferential webbing of the first loop, and wherein the base panel further comprises a putting hole and adjustment straps for adjustment of the tension on the base panel.

* * * * *